US007597045B2

(12) United States Patent
Sargent

(10) Patent No.: US 7,597,045 B2
(45) Date of Patent: Oct. 6, 2009

(54) PORTABLE COMPACTOR FOR MATERIALS, ESPECIALLY WASTE AND RECYCLABLE MATERIALS

(75) Inventor: Kevin Sargent, Miramichi (CA)

(73) Assignee: K. C. Sargent Sales Ltd., Miramichi, New Brunswick (CA)

( * ) Notice: Subject to any disclaimer, the term of this patent is extended or adjusted under 35 U.S.C. 154(b) by 0 days.

(21) Appl. No.: 12/082,909

(22) Filed: Apr. 14, 2008

(65) Prior Publication Data

US 2009/0199727 A1 Aug. 13, 2009

(30) Foreign Application Priority Data

Feb. 8, 2008 (CA) ..... 2620778

(51) Int. Cl.
*B30B 15/32* (2006.01)
*B30B 7/04* (2006.01)

(52) U.S. Cl. ..... 100/218; 100/226; 100/232; 100/245; 100/246; 100/269.17

(58) Field of Classification Search ..... 100/178, 100/179, 214, 218, 226, 228, 233, 240, 245, 100/250, 255, 269.01, 269.18, 232, 246, 100/269.17, 269.19

See application file for complete search history.

(56) References Cited

U.S. PATENT DOCUMENTS 3,625,140 A * 12/1971 Glanz ..... 100/100
3,672,520 A * 6/1972 Linville ..... 414/513
3,695,175 A * 10/1972 Bausenbach et al. ..... 100/193
5,178,062 A * 1/1993 Spiers ..... 100/269.17

* cited by examiner

*Primary Examiner*—Jimmy T Nguyen
(74) *Attorney, Agent, or Firm*—Frank J. Bonini, Jr.; John F. A. Earley, III; Harding, Earley, Follmer & Frailey, P.C.

(57) ABSTRACT

A compactor comprising a base structure having a compaction chamber mounted thereto is provided. The compactor further comprises a ram which is horizontally movable through the compaction chamber between a withdrawn position and an extended position. An actuator is pivotally movable mounted to the ram at a first end portion. The actuator moves the ram from the withdrawn position to the extended position. An actuator frame is pivotally movable mounted to the base structure at a first end portion such that the pivot of the actuator frame is aligned with the pivot of the actuator when the ram is in the withdrawn position. A second opposite end portion of the actuator is mounted to a second opposite end portion of the actuator frame. The actuator frame is movable between a transport position where the actuator is oriented substantially vertical and an operating position where the actuator is oriented substantially horizontal.

10 Claims, 8 Drawing Sheets

PORTABLE COMPACTOR FOR MATERIALS, ESPECIALLY WASTE AND RECYCLABLE MATERIALS

FIELD OF THE INVENTION

The present invention relates to material compactors especially for waste or recyclable materials, and more particularly relates to compactors which may be transported by a truck, trailer or other vehicle for the purpose of compacting recyclable materials for subsequent transportation of the compacted recycled materials.

BACKGROUND OF THE INVENTION

Recycling programs may result in the collection, at collection stations, of sorted or unsorted recyclable materials, including, for example, plastic beverage bottles, aluminum beverage cans, and other recyclable materials (hereinafter collectively referred to as "recyclable materials" unless otherwise specifically indicated). In some cases, the recyclable materials are sorted at the collection stations and thereafter temporarily stored in large compressible containers such as fabric bags, in which, for example, between 1000 and 2000 beverage bottles or beverage cans can be temporarily stored, for subsequent transportation to a processing facility factory. In some cases, it may be necessary to transport collected recyclable materials a significant distance from the collection stations. However, as the recyclable materials may contain large volumes of air (for example, the volume of air in an empty plastic beverage bottles or empty aluminum beverage cans), when transporting and subsequently storing these recyclable materials, there may be significant inefficiencies and waste associated with the transporting and storing processes, as these large volumes of air are transported and stored.

It is desirable to have a portable compactor which may be transported to or installed at one or more of the collection stations, which may be utilized to receive the containers, e.g. the fabric storage bags filled with sorted recyclable materials, and thereafter compact the filled containers (and the contents thereof) and thereafter transport (and, where appropriate and/or desirable, store) the compacted recyclable materials and containers for subsequent processing of the recyclable materials. Preferably the compactor may be carried by a truck or trailer vehicle.

PRIOR ART

Compactors and balers for trash or waste material are well known. Typically these are loaded from the top, e.g. through a hopper, and have a hydraulic cylinder which moves horizontally in a compaction chamber to compress the trash. The trash may be compacted against a door which can be slid open when sufficient compaction has taken place, or may it may be compacted against a discharge channel which has converging walls, sometimes termed a "size reduction chamber". In the latter case, it is usual for the compacting ram to have teeth at its forward end for the purpose of breaking up large pieces of material in the compaction chamber; such designs are shown for example in:

U.S. Pat. No. 3,541,949, issued Nov. 24, 1970 to Clar, and

U.S. Pat. No. 4,134,335, issued Jan. 16, 1979 to O'Rourke, et al.

The need for teeth on the ram in these compactors has been noted as a drawback, since the teeth become worn and need replacement.

In some compactors or baling machines the compaction is done in two stages, by first and second hydraulic rams operating successively along directions perpendicular to each other. Such a design for example is shown in U.S. Pat. No. 5,203,261, issued Apr. 20, 1993 to Davis. This patent is concerned with compacting cans and similar articles for recycling; like many designs it is fed from the top, and the two mutually perpendicular rams act horizontally. Designs of this type, with two mutually perpendicular, horizontal rams, occupy considerable floor space, more than is desirable in a compactor intended to be carried by a vehicle. Also, the Davis design uses a slidable door against which to perform the second stage compaction; this slidable door requires its own hydraulic cylinder and this increases the expense and complexity of the apparatus.

SUMMARY OF THE INVENTION

Accordingly, one object of the present invention is to provide a recyclable materials compactor which is of relatively simple form and which is compact enough to be carried in a vehicle.

The apparatus may make use of size reduction chamber for a second stage of compaction, but does not require the use of teeth on the compacting ram since the material being compacted can be separated into distinct batches by having been placed into bags or other compressible containers, which can be fed singly to the apparatus.

In accordance with this feature of the invention, the method of compacting waste material comprises:

- placing said material in compressible containers such as bags,
- loading a single such filled container into a compaction chamber in compaction apparatus via a side inlet,
- compressing said container in a first direction by means of a first ram communicating with said chamber,
- further compressing said container in a second direction by means generally perpendicular to the first direction by means of a second ram while simultaneously ejecting said container via a size reduction chamber.

As indicated, in this method, unlike in the type of garbage compactor described by Clar or O'Rourke et al., the ram which moves the material into the size reduction chamber has no cutting teeth and needs none.

The containers are preferably loaded into the side of the compaction chamber, rather than into the top as is common with trash compactors. This of course means less lifting for the operators. It also allows the first ram to operate vertically, thus saving floor space, as compared for example to the Davis patent and other similar designs with mutually perpendicular, horizontal rams. A special feature of the invention is the means which allow the second ram, which acts horizontally, to have a good range of travel and yet to occupy little space in an inoperative condition when the vehicle is loaded and ready for travel.

In accordance with this latter feature of the invention, in apparatus suitable for use in a vehicle for compacting waste, including a base which carries the compaction chamber and which has a horizontally operating compaction ram movable in said chamber and a hydraulic cylinder for moving the horizontally movable ram, said cylinder has its outer end carried by a frame which has a first pivotal connection to the base allowing the cylinder to pivot 90° from a horizontal orientation up to a vertical orientation. The piston rod of the cylinder is connected to the horizontally operating ram by a second pivotal connection which is aligned with the first pivotal connection when the compaction ram is in a withdrawn position relative to the compaction chamber. In the preferred apparatus described, having also a vertically operating ram for giving a first stage compaction, this arrangement allows the second, horizontally operating ram to be folded vertically close to the vertically operating ram when the compaction apparatus is in inoperative condition for traveling. When folded out into the operative condition for loading the vehicle, the horizontally operating ram can project out of the rear door of the vehicle.

As indicated, the ram giving the first stage of compaction preferably operates vertically. To reduce the height of the hydraulic cylinder means needed for this first, vertically operating ram, such cylinder means may be inclined at an angle to the vertical. In the initial position, with the first ram raised, the cylinder means may be at an angle of more than 30° to the vertical; this angle reduces when the cylinder is extended. The fact that this cylinder means is providing much less than its maximum downwards force in the first stage of its action is unimportant since the compaction force needed at this stage is not as high as in the later stages. Preferably, these cylinder means comprises two cylinders symmetrically arranged so that the horizontal components of force which they apply to the first operating ram are balanced. The ram itself is in the form of a carriage having rollers which move along vertical guideways extending up from the corers of the compaction chamber.

The apparatus also includes means for tying the compacted containers; this however is not part of the present invention.

BRIEF DESCRIPTION OF THE DRAWINGS

A preferred embodiment of the present invention is described below with reference to the accompanying drawings, in which.

DESCRIPTION OF THE PREFERRED EMBODIMENT

Figure 1:
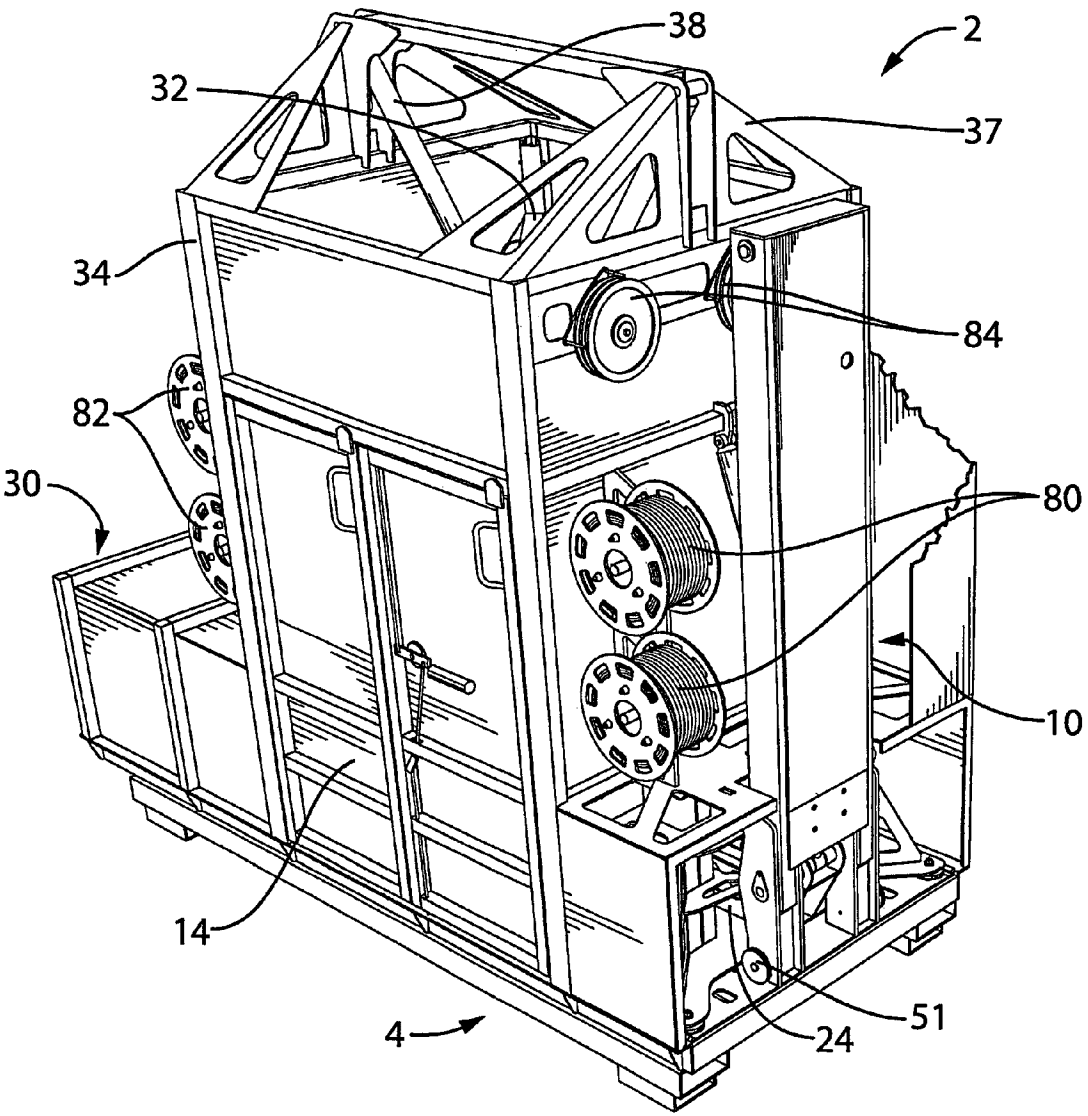
FIG. 1 is an isometric view of the apparatus of the present invention in the stored position.
Figure 2:
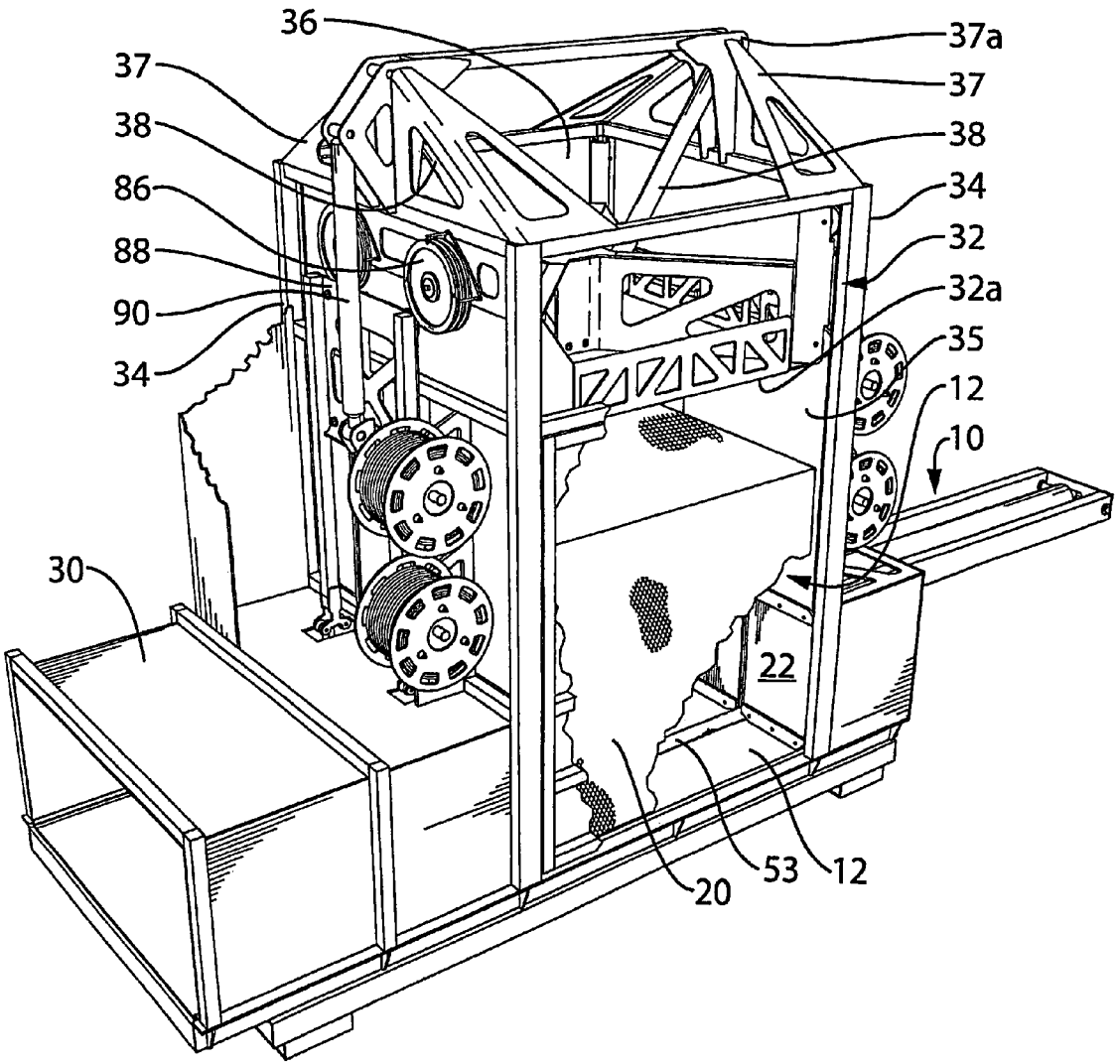
FIG. 2 is a view of the same apparatus in the operative condition, with entry doors removed, with compaction rams retracted, and with the chamber holding an uncompressed container.
Figure 3:
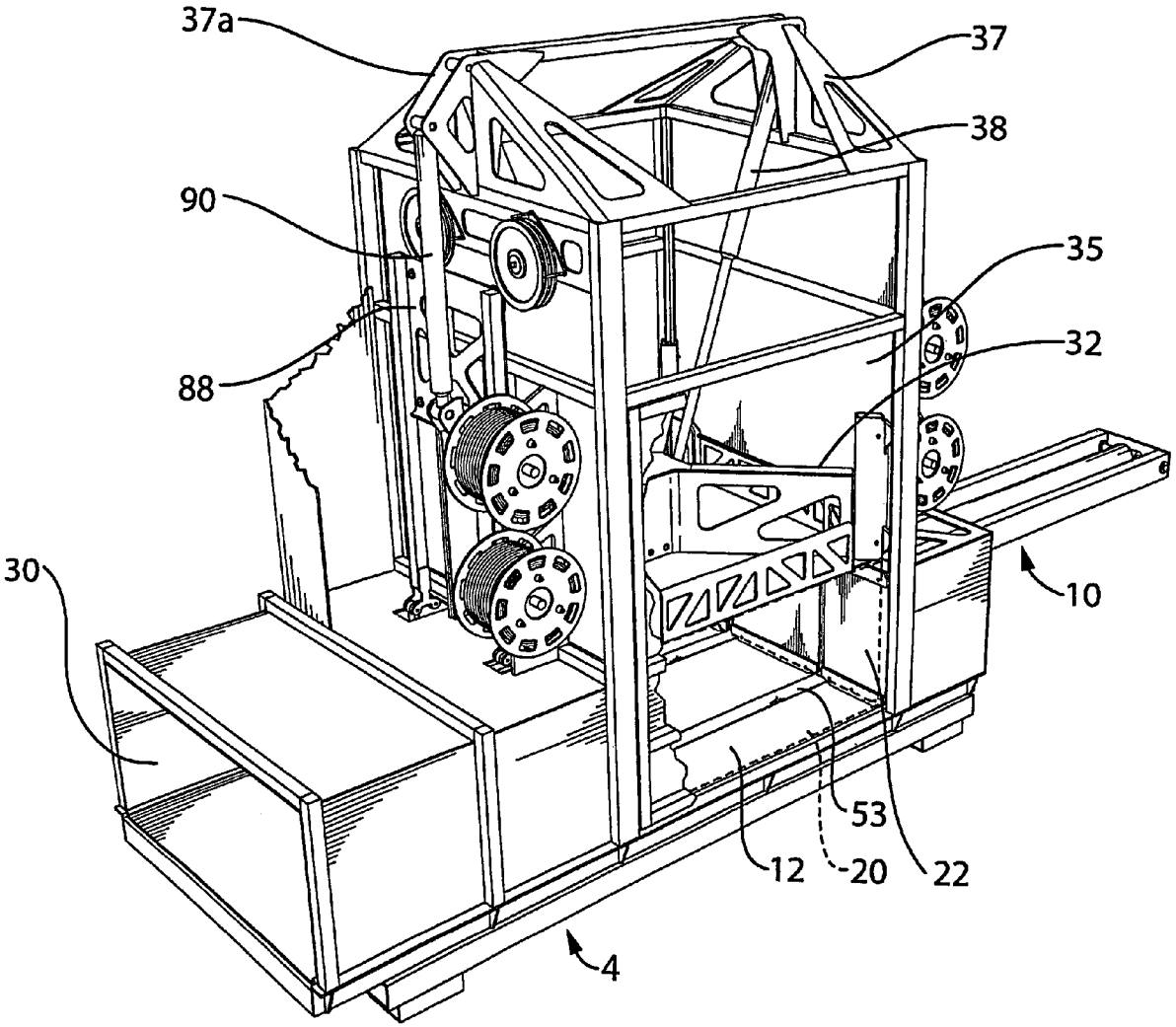
FIG. 3 is a similar view of the apparatus with the container having been vertically compacted.
Figure 4:
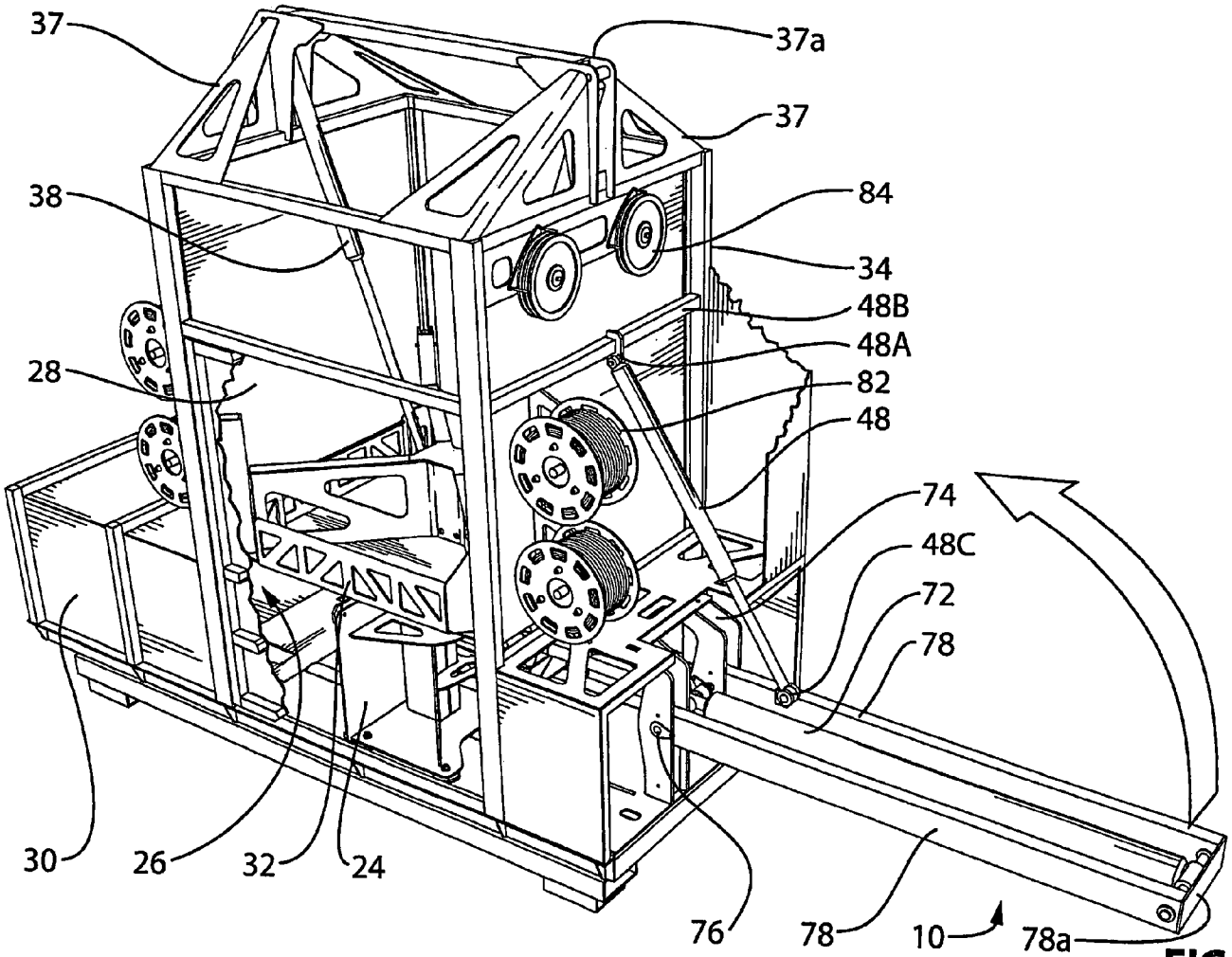
FIG. 4 is a view of the apparatus with no container in place, and showing the rear part of the apparatus.
Figure 6A:
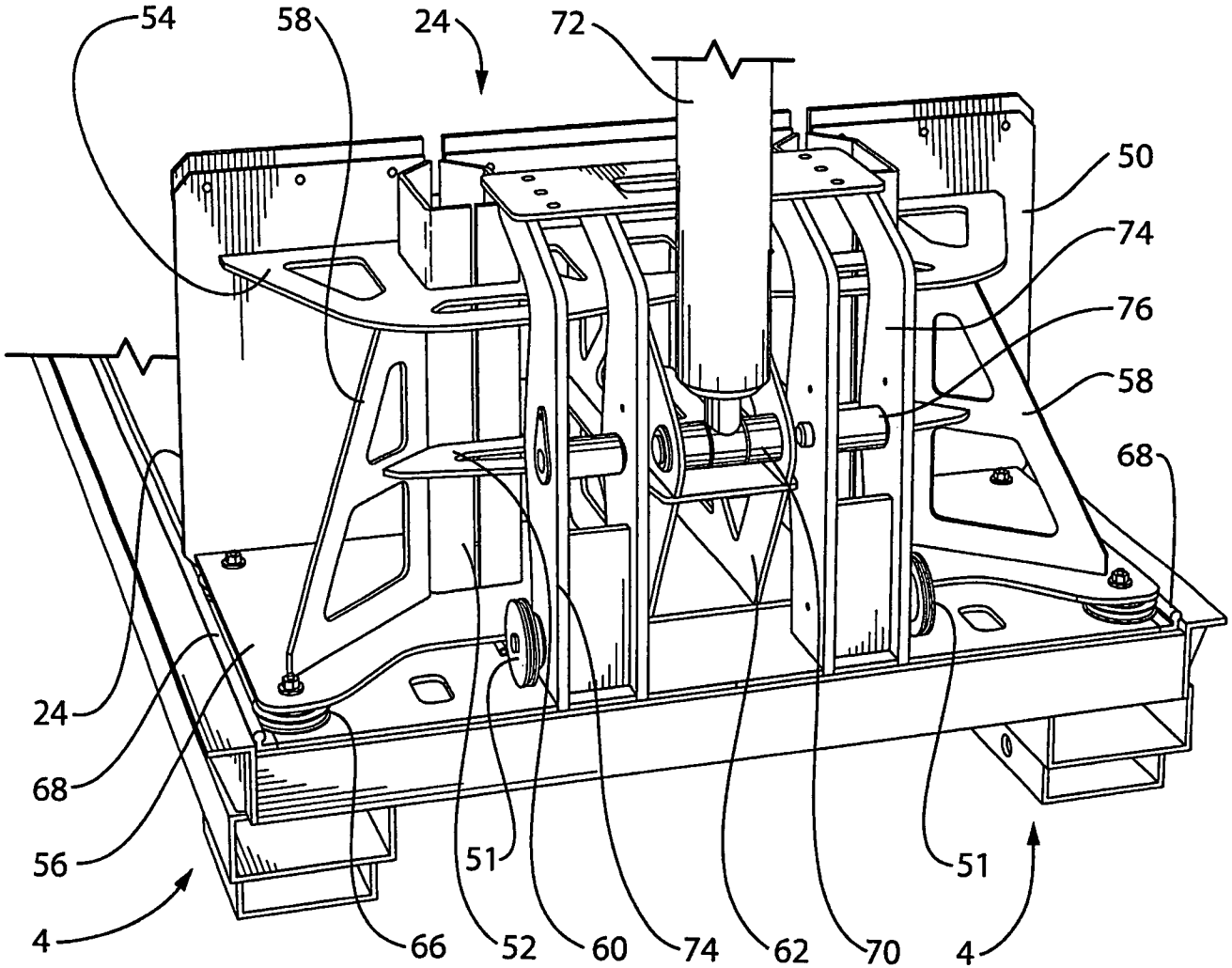
FIG. 6A is an enlarged rear isometric view of the means for supporting the second ram, and a portion of the second ram and its connection to the operating cylinder, with the latter cylinder in its inoperative position.
Figure 6B:
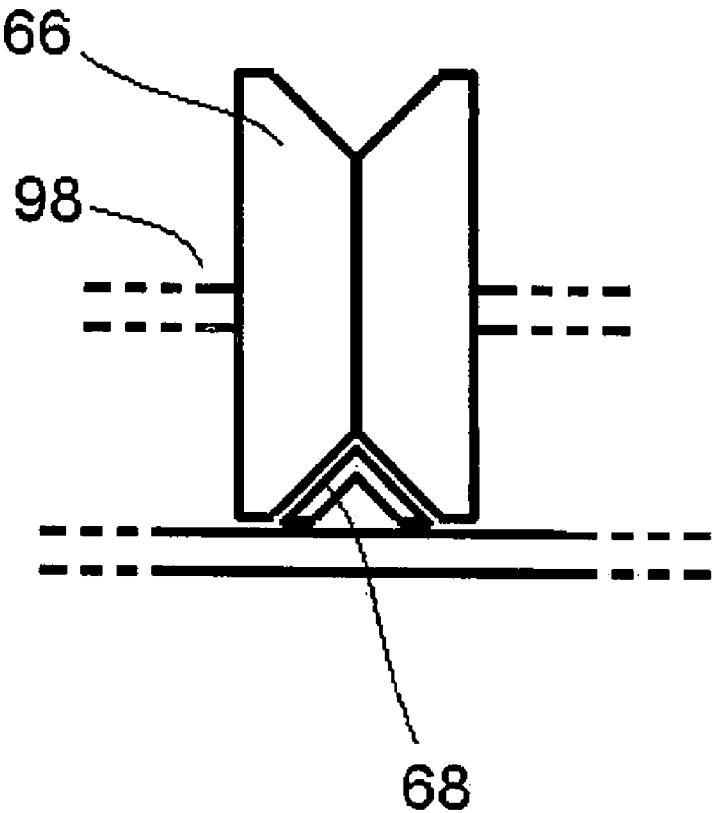
FIG. 6B is a cross-section view of one embodiment of a horizontally mounted grooved roller of one embodiment of the present invention.
Figure 7:
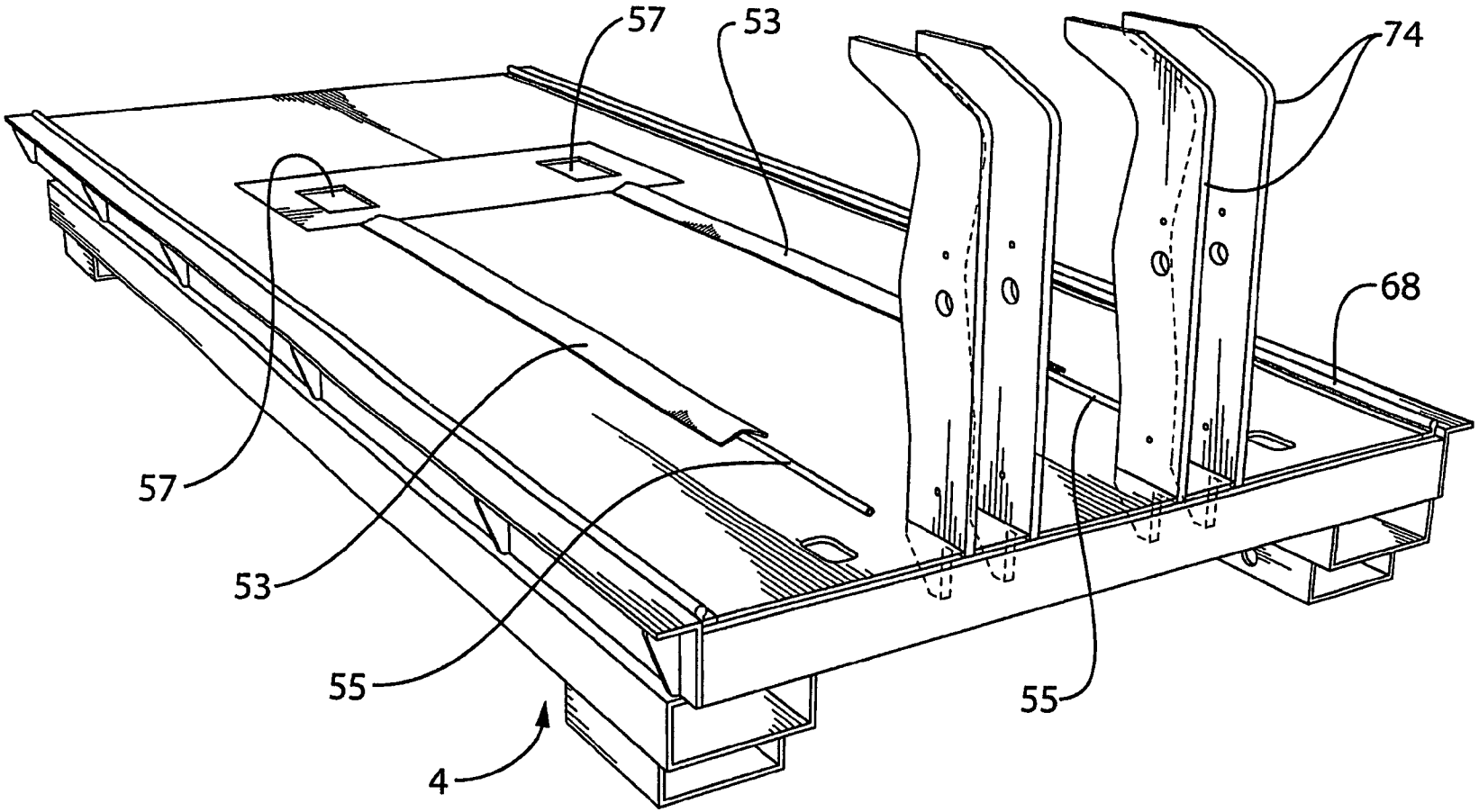
FIG. 7 is a view of a base component of the apparatus showing support means for the second, horizontally operating ram.

With reference to FIGS. 1 and 2, a compactor apparatus, generally shown as 2, has a base member assembly 4 which is separately illustrated in FIG. 7, and which may be bolted or otherwise securely mounted to the floor of, for example, a truck or trailer (not shown). The apparatus has an the ejection ram assembly, generally shown as 10, which in FIG. 1 is in the vertical storage position; as illustrated in FIGS. 2, 3 and 4 this ejection ram assembly is in the horizontal operative position. Mounting means for this ram assembly will be described below with reference to FIGS. 4, 6 and 7.

As illustrated in FIGS. 2 to 4 the apparatus has a compaction chamber 12, which as illustrated in FIG. 1 has doors 14 which open to provide a side inlet through which a fabric storage bag 20 filled with recyclable material may be inserted into the compaction chamber 12, the doors 14 thereafter being securely fastened in the closed position (illustrated in FIG. 1) during the compaction phase described hereinafter. One end wall of the compaction chamber 12 is formed by the face 22 of the ejection ram 24 best seen in FIG. 4, details of which will be described with reference to FIG. 6. As seen in FIG. 4, an opening 26 is provided in the lower portion of the end wall 28 of the compaction chamber opposite the ejection ram assembly 24, the opening 26 providing a passageway to an exit chamber 30 as more fully described herein.

A vertically acting compaction ram 32 having a lower face plate 32*a* initially positioned above the compaction chamber 12, is provided. This ram 32 moves within a structure which includes vertical corner members 34 supporting opposed end walls 28 and 35 of an upper part of the compaction chamber 12, a closed side face 36, and the side doors 14. At front and rear of the central part of the apparatus the upper ends of members 34 support triangulated brackets 37 the apices 37*a* of which provide firm anchors for the outer ends of double acting hydraulic cylinders 38, the lower ends of which cylinders are attached to the ram 32, as described more fully below. The compaction ram 32 can be lowered by the two double-acting hydraulic cylinders 38 to come into contact with the fabric storage bag or container 20 filled with recyclable material positioned within the compaction chamber 12. Further lowering of the ram 32 compacts the fabric storage bag 20 to a desired height, as shown in FIG. 3. Once the lower face plate 32*a* of the compaction ram is at or below the level of the top of opening 26 in the end wall 28 wall of the compaction chamber, the compaction ram 32 is maintained in that compacting position. Thereafter, the horizontal ejection ram 24 is activated and extended, pushing the compacted fabric storage bag filled with now compacted recyclable materials through the opening 26 in the wall 28 and into the exit chamber 30.

In the preferred embodiment of the present invention, the walls of the exit chamber 30 are, over their length, each gently angled inwardly a short distance of approximately one half inch to reduce the width of the chamber by about one inch over its length to produce a gently tapered narrowing exit passageway through the exit chamber, (it being understood that a range of angles and width narrowing distances are possible in alternative embodiments of the present invention and that in an alternative embodiment of the present invention, the amount of angling and width narrowing distance may be adjustable). The inwardly angled/tapered walls constitute a size reduction chamber and thus provide some resistance to the movement of the compacted fabric storage bag 20 therethrough. After each compacted fabric storage bag has been pushed into the exit chamber 30 by the ejection ram 24, it will remain in the exit chamber until expelled/pushed therefrom by the force applied thereto by the arrival of the next compacted fabric storage bag which is being forced through the opening 26 and into the exit chamber 30. In this way, the force applied on this next compacted fabric storage bag by the ejection ram is partially opposed by the resistance of the previously processed fabric storage bag wedged in the exit chamber 30, the ejection ram being able to overcome this resistance and forcing the most recently compacted fabric storage bag into the exit chamber 30 while at the same time moving the immediately previously processed fabric storage bag along the exit chamber 30 until it is expelled therefrom. In this way, the compacted shape and configuration of each processed fabric storage bag may be established.

As indicated above, the apparatus is designed to minimize both the height and length of the apparatus, as compared to what would be expected for conventional apparatus having both vertically and horizontally operating rams.

Figure 5:
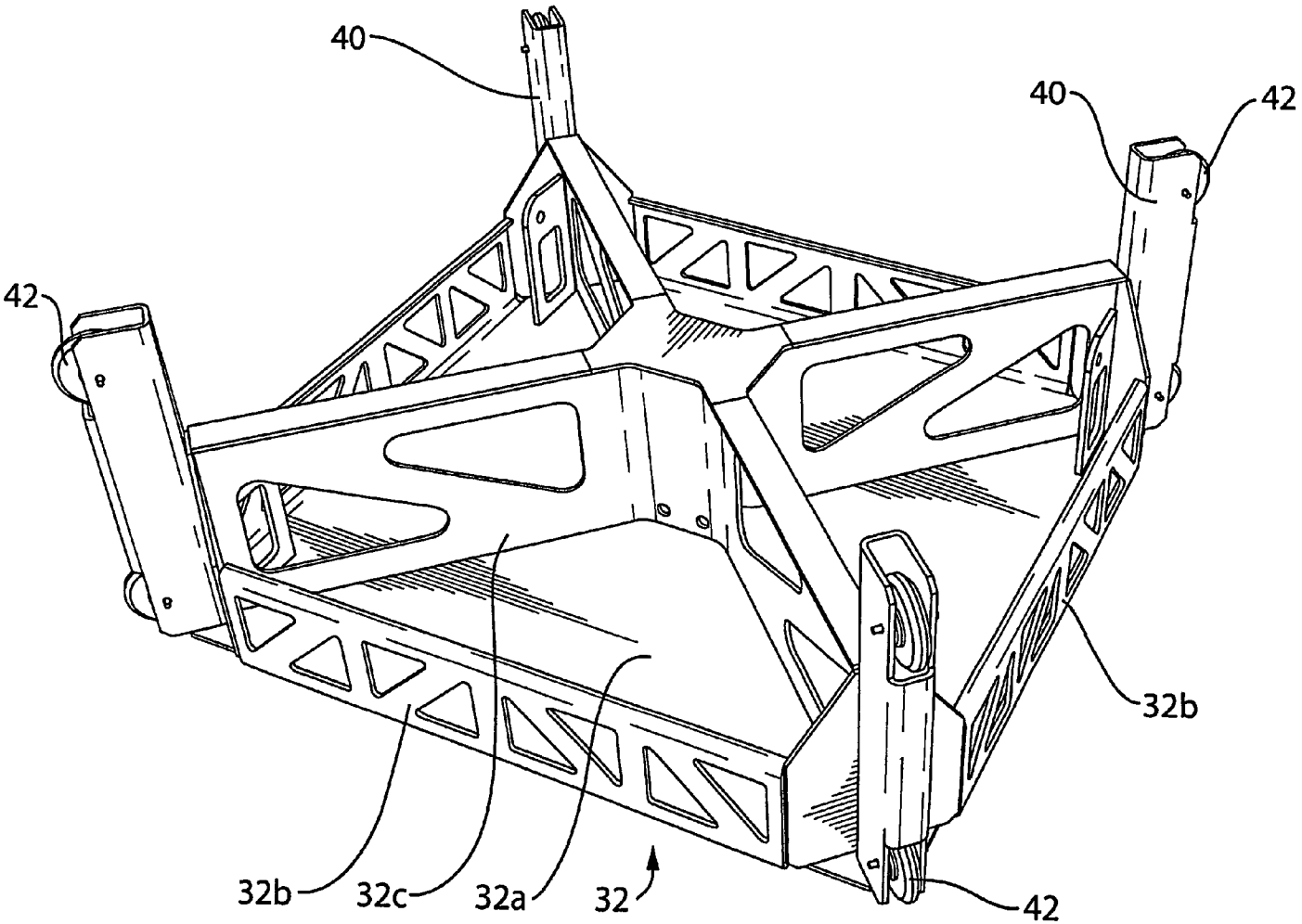
FIG. 5 is a view of the vertically operating carriage component which constitutes the first ram.

As seen in FIG. 5, the vertically operating compaction ram 32 is formed as a horizontal rectangular face plate 32*a* with stiffening side ribs 32*b*, and stiffening cross ribs 32*c*. At each corner the ribs support open vertical hollow structural tube members 40 with coped ends which are each provided with upper and lower rollers 42, which rollers move in tracks provided on the inner facing surfaces of corner members 34. The cross ribs 32*c* support a central block 44 the opposed ends of which provide anchor points for the piston rods of cylinders 38. Accordingly the cylinders 38 slope inwardly from the apices of the brackets 37 to the central block 44 of the ram 32. When the ram 32 is in its uppermost position, as in FIG. 1, the cylinders 38 slope at an angle of slightly more than 30° to the vertical (as seen from the side of the apparatus), thus reducing the height compared to what would be needed with conventional vertical cylinders. This slope reduces the downwards force which is applied to the ram, as compared to the force which would be given by vertical cylinders; however the reduction occurs mainly in the initial stages of compression, when comparatively little force is required; when fully extended the cylinders are within about 10° of the vertical.

FIGS. 4, 6A and 7 show how the ejection ram assembly 10 is pivotally mounted to the base member 4 so as to be pivotable (as illustrated by the arrow in FIG. 4) from the operative position of FIGS. 2 to 4 into the vertical storage position of FIG. 1 by means of double acting hydraulic pivoting cylinder 48 which is securely and pivotally attached 48A, for example, to a cross-member 48B and securely and pivotally attached 48C for example, to the one side of the frame member 78.

FIG. 6A shows details of the ejection ram 24 and its mounting means. The front face 22 of the ram 24 (seen in FIGS. 2 and 3) is provided by a rectangular plate 50 provided with vertical stiffening members 52, which are in turn supported by upper and lower horizontal plates 54 and 56 and by outer vertical brackets 58 which connect the horizontal plates 54 and 56 and have their inner edges attached to members 52. A further, intermediate, horizontal plate 60 connects vertical brackets 58 to a pair of inner vertical brackets 62, having a connection to the ejection ram cylinder as will be described.

The lower horizontal plate 56 carries, at each of its four corners, a short vertical axle which rotatably supports a grooved roller 66; these grooved rollers movably engage inwardly projecting flanges of parallel rails 68, which run along front and back sides of the bottom of the compaction chamber, being carried by base 4. This roller and rail combination allows the ejection ram 24 to have relatively frictionless movement along the compaction chamber. In an alternative embodiment of the present invention, as illustrated in FIG. 6B, each of the grooved rollers 66 are rotatably supported by a short horizontal axle 98, each of the grooved rollers 66 being movably engaged with parallel rails 68 in secure engagement with and supported by the base and the parallel rails 68 extending along the length of travel of the ejector ram, thereby supporting and positioning the ejector ram as it is extended and retracted (in this embodiment, as illustrated in FIG. 6B, inverted lengths of angle material welded or otherwise securely fastened to the base may be used to provide the parallel rails 68).

As also shown in FIG. 6A, the inner vertical brackets 62 have rear ends which carry a horizontal shaft 70 which provides a pivot connected to the piston rod of double-acting hydraulic cylinder 72. FIGS. 6A and 7 also show fixed support brackets 74 extending upwards from the base assembly 4; as shown in FIG. 4 these brackets have a pivotal connection at 76 to frame members 78 constituting part of the ejector ram assembly 10. The outer ends of members 78 hold the outer end of the ejector cylinder 72 by means of a pin (not shown) spanning the members 78 proximate the cross member closure plate 78*a* about which pin a pivot sleeve (not shown) is positioned which is securely attached to the ejector cylinder 72. The arrangement is such that when the ejector ram 24 is fully withdrawn, as in FIG. 6, the pivot 70 is aligned with the pivotal connection 76, so that in this situation the ejector ram assembly 10, including frame 78 and the cylinder 72, can be pivoted from the horizontal position to the vertical position by the pivoting cylinder 48. As seem in FIG. 1, this brings the ejector ram assembly 10 close to the main structure formed by the corner members 34; the height of the ejector ram assembly is then slightly less than the height of the main structure. In practice, this allows the ram assembly 10 to project out of the back of a vehicle in which it is mounted when the vehicle is being loaded, and to be folded clear of the rear doors of the vehicle for traveling.

In the preferred embodiment of the present invention, the compacted fabric storage bag may be securely bound in the compacted state by binding the compacted bag with wire, plastic or other banding material. For this purpose spools of banding material 80 and 82 are mounted respectively on the rear and front of the apparatus, outside the rear and front end walls 28 and 35 as illustrated in FIGS. 1 to 4, which spools supply banding material which passes over pulleys 84, 86, and 51 shown in FIGS. 1, 2 and 6A respectively, subsequently being wrapped around the compacted fabric storage bag and thereafter securely fastened to maintain the compacted fabric storage bag in the compacted position. The means for feeding the banding material includes hollow steel tubes 55 (through which the banding material may freely pass) positioned beneath inverted lengths of angle material 53 welded or otherwise securely fastened to the base as shown in FIG. 7 and includes vertically movable carriages 88 movable by hydraulic cylinders 90 such as shown in FIG. 3, which carriages carry probes for taking the banding material down to tying means (not shown) incorporated in the base 4 and positioned beneath holes 57 in the base through which holes 57 the binding material supplied by way of the probes and by way of the hollow steel tubes pass for tying. However, these tying means are not part of the present invention, and may be conventional, such as have been used for many years in the tying of hay bales.

The hydraulic cylinders referenced herein may be operated manually, or automatically to provide for the movement of the components described herein, it being understood that alternative mechanical, hydraulic or electrical components may be used as required or desired to achieve the above-described movement of the components described herein.

In one embodiment of the present invention, the compactor may be powered by the truck, trailer or other vehicle on which it is installed, it being understood that in an alternative embodiment of the present invention, it may be temporarily or permanently installed in a fixed location, such as at a depot or redemption centre where materials for recycling may be collected for subsequent transportation.

The present invention has been described herein with regard to preferred embodiments. However, it will be obvious to persons skilled in the art that a number of variations and modifications can be made without departing from the scope of the invention as described herein.

What is claimed is:

1. A compactor comprising:

a base structure having a compaction chamber mounted thereto;

an ejection ram horizontally movable through said compaction chamber between a withdrawn position and an extended position to eject material from said compaction chamber;

a compaction ram acting in a direction perpendicular to a moving direction of the ejection ram;

an actuator having a first end portion pivotally mounted to said ejection ram at a first pivot axis, the actuator for moving the ram from the withdrawn position to the extended position; and, an actuator frame having a first end portion pivotally mounted to the base structure at a second pivot axis such that the second pivot axis of the actuator frame is horizontally aligned with the first pivot axis of the actuator when the ejection ram is in the withdrawn position, wherein a second opposite end portion of the actuator is pivotally mounted to a second opposite end portion of the actuator frame and wherein the actuator frame is movable between a transport position with the actuator being oriented substantially vertical and an operating position with the actuator being oriented substantially horizontal.

2. A compactor as defined in claim 1 wherein the actuator comprises a hydraulic cylinder.

3. A compactor as defined in claim 1 comprising:

a frame structure mounted to the base structure; and, an actuating mechanism mounted to the actuator frame and the frame structure for moving the actuator frame.

4. A compactor as defined in claim 3 wherein the actuating mechanism comprises a hydraulic cylinder.

5. A compactor as defined in claim 1 wherein a face of the ejection ram when in the withdrawn position forms a portion of a wall of the compaction chamber and wherein an opposite wall comprises an opening.

6. A compactor as defined in claim 1 wherein the compaction ram is vertically movable and wherein the compaction chamber comprises a side inlet for providing material for compacting.

7. A compactor as defined in claim 5 comprising an exit chamber connected to the opening.

8. A compactor as defined in claim 5 wherein at least a wall of a portion of the exit chamber forms a size reduction chamber.

9. A compactor as defined in claim 1 comprising a guide mechanism for guiding the ejection ram during movement between the withdrawn position and the extended position.

10. A compactor as defined in claim 9 wherein the guide mechanism comprises a plurality of rollers mounted to the ejection ram interacting with respective guide rails mounted to the base structure.

* * * * *